US005494535A

United States Patent [19]

Keller et al.

[11] Patent Number: 5,494,535

[45] Date of Patent: Feb. 27, 1996

[54] MODIFICATION OF METAL SURFACES

[75] Inventors: Harald Keller, Ludwigshafen; Gerhard Hoffmann, Otterstadt; Walter Denzinger, Speyer; Rainer Fassler, Stuttgart, all of Germany

[73] Assignee: BASF Aktiengesellschaft, Ludwigshafen, Germany

[21] Appl. No.: 404,713

[22] Filed: Mar. 15, 1995

[30] Foreign Application Priority Data

Mar. 18, 1994 [DE] Germany ..... 44 09 306.3

[51] Int. Cl.[6] ..... C23C 22/83

[52] U.S. Cl. ..... 148/251; 148/257; 148/265; 106/14.15

[58] Field of Search ..... 148/257, 251; 106/14.15

[56] References Cited

U.S. PATENT DOCUMENTS

| | | | |
|---|---|---|---|
| 4,265,677 | 5/1981 | Mueller et al. . | |
| 4,466,840 | 8/1984 | Frank | 106/14.15 |
| 4,517,028 | 5/1985 | Lendert | 148/251 |
| 4,637,838 | 1/1987 | Rausch et al. . | |
| 4,783,224 | 11/1988 | Sako et al. | 148/6.27 |
| 4,978,399 | 12/1990 | Kodamg | 148/251 |
| 5,112,413 | 5/1992 | Carey | 148/251 |
| 5,209,788 | 5/1993 | McMillen | 148/257 |
| 5,226,976 | 7/1993 | Carlson | 106/14.15 |
| 5,373,076 | 12/1994 | Pinschmide, Jr. | 526/303.1 |

FOREIGN PATENT DOCUMENTS

| | | |
|---|---|---|
| 3213873 | 4/1982 | Germany . |
| 3534273 | 9/1985 | Germany . |
| 4208056 | 3/1992 | Germany . |

OTHER PUBLICATIONS

Organischer Metallschutz . . . Josef Rufo–Hanover: Vincentz, 1993, p. 646f.

Effect of Polyethyleneimine . . . Nair et al., Journal of Coatings Tech. vol. 65, No. 819 Apr. 1993.

Verbesserung der Nasshaftfestigkeit . . . Gao et al. farbe+lack, 98 (1992), No. 12, p. 917.

JP A 58 144 477, Chem. Abst. 99/216843.

*Primary Examiner*—Sam Silverberg

*Attorney, Agent, or Firm*—Keil & Weinkauf

[57] ABSTRACT

Cleaned or chemically pretreated metal surfaces are modified using aqueous solutions of amino-containing organic polymers, the metal surfaces thus modified being particularly suitable for coating by cathodic electrodeposition.

7 Claims, No Drawings

MODIFICATION OF METAL SURFACES

The present invention relates to a method of modifying cleaned or chemically pretreated metal surfaces with aqueous solutions of organic polymers and to the use of the modified metal surfaces for coating, especially for cathodic electrodeposition.

The improvement of the wet adhesion of organic coatings to steel surfaces which are treated with highly diluted solutions of polyacids, such as polyacrylic and polymethyleneacrylic acid, and which show improved adhesion to alkyd/melamine resins, epoxy resins and polyurethane resins, is described by Z. Gao, H. Yamabe, B. Marold and W. Funke in farbe+lack, 98 (1992), No. 12, p. 917.

The phosphating of iron and ferro-alloys is a very common method of increasing the corrosion resistance of the metal and of improving adhesion to a coating.

In addition, the publication J. of Coatings Technol. 65 (1993), No. 819, pp. 59–64 discloses phosphating solutions containing polyethyleneimine as additive and giving phosphate coats having low permeability to moisture.

Electrodeposition coating is generally carried out on a phosphated substrate. Improved adhesion to the coating material, and to electrodeposition coating materials in particular, is often achieved by modifying the phosphating baths (cf. e.g. DE-A 22 32 067, Japanese Patent Application No. 58 144 477 (Chemical Abstracts 99/216843) and DE-A 34 08 577).

A further increase in adhesion to the coating material is brought about by using special, passivating afterwashes, for example with chromate solutions (in this respect cf. also Dr. Josef Ruf, Organischer Metallschutz: Entwicklung undAnwendung von Beschichtungsstoffen [Organic Protection of Metals: Development and Application of Coating Materials], Josef Ruf—Hanover: Vincentz, 1993, p. 646f.).

However, adhesion to the coating material and, in particular, corrosion resistance on the conversion coats used do not always come up to the required standard.

It is an object of the present invention to bring about a substantial improvement in adhesion to the coating material, by means of an additional, thin polymer layer applied to cleaned metal surfaces or to conversion coats employed in industry, and in this way to achieve an improved protective effect and, in particular, to reduce underfilm corrosion of the coating.

We have found that this object is achieved particularly advantageously in that the cleaned or chemically pretreated metal surface is coated with a thin layer of a polymer which contains amino groups.

The present invention relates to a method of modifying cleaned or chemically pretreated metal surfaces with aqueous solutions of organic polymers, wherein the cleaned or chemically pretreated metal surfaces are treated with an aqueous solution of organic polymers which contain amino groups.

This treatment, using an aqueous solution of the organic polymer which contains amino groups, can be effected by pouring, spraying or dipping.

The metal surfaces involved are, in particular, those of iron, ferro-alloys, zinc, aluminum, copper, cobalt, nickel or manganese, in which context preferred metal surfaces are those which have been chemically pretreated, especially those having phosphate conversion coats, which may or may not have been afterwashed with water or a chromate solution.

For the method of the invention, preferred organic polymers which contain amino groups are hydrolysis products of polymers comprising units of the formula (I)

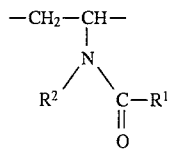

(I)

in which $R^1$ and $R^2$ are identical to or different from one another and are hydrogen or alkyl of 1 to 6 carbon atoms.

The present invention also relates to the use of the modified metal surfaces produced by the method of the invention for coating, especially for cathodic electrodeposition coating.

The metal surfaces modified by the method of the invention offer a markedly improved protection against corrosion, especially after electrodeposition coating and in particular after coating by cathodic electrodeposition.

Details of the method of the invention are as follows.

The metal surfaces to be modified by the method of the invention are suitably those of iron, ferro-alloys, steel, zinc, aluminum, copper, cobalt, nickel and manganese, which may have been either cleaned (degreased) or chemically pretreated, for example phosphated and/or chromated.

The organic polymers which contain amino groups are generally applied from aqueous solution, for example by pouring, spraying or dipping and then drying the modified metal surfaces.

The organic polymers which contain amino groups are preferably hydrolysis products, containing amino groups, of polymers comprising structural units of the formula (I)

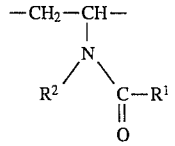

(I)

in which $R^1$ and $R^2$ are identical to or different from one another and may be hydrogen or alkyl of 1 to 6 carbon atoms, such as methyl, ethyl, n-propyl, isopropyl, n-butyl, isobutyl, tert-butyl, amyl, n-hexyl, isohexyl or cyclohexyl.

Examples of such hydrolysis products are those of homo- and copolymers of N-vinylformamide, N-vinyl-N-methylformamide, N-vinylacetamide, N-vinyl-N-methylacetamide, N-vinyl-N-ethylacetamide, N-vinylpropionamide and N-vinyl-N-methylpropionamide, with N-vinylformamide being preferred because of its higher propensity to undergo hydrolysis. Suitable comonomers are monoethylenically unsaturated carboxylic acids of 3 to 8 carbon atoms, and the water-soluble salts of these monomers.

Examples of this group of comonomers include acrylic acid, methacrylic acid, dimethylacrylic acid, ethacrylic acid, maleic acid, citraconic acid, methylenemalonic acid, allylacetic acid, vinylacetic acid, crotonic acid, fumaric acid, mesaconic acid and itaconic acid. Preferred members of this group are acrylic acid, methacrylic acid and maleic acid, or else mixtures of the carboxylic acids mentioned, especially mixtures of acrylic acid and maleic acid, or mixtures of acrylic acid and methacrylic acid. In the copolymerization the comonomers can be employed either in the form of the free carboxylic acids or in partially or completely neutralized form. Examples of neutralizing agents for the monoethylenically unsaturated carboxylic acids are alkali metal and alkaline earth metal bases, ammonia or amines, for example sodium hydroxide, potassium hydroxide, sodium carbonate, potash, sodium hydrogen carbonate, magnesium oxide, calcium hydroxide, calcium oxide, ammonia, triethylamine, ethanolamine, diethanolamine, triethanolamine, morpholine, diethylenetriamine or tetraethylene-pentamine.

Other suitable monomers are, for example, the esters, amides and nitriles of the abovementioned carboxylic acids, for example methyl acrylate, ethyl acrylate, n-propyl and isopropyl acrylates, n-butyl and isobutyl acrylates, hexyl acrylate, methyl methacrylate, ethyl methacrylate, butyl methacrylate, hydroxyethyl acrylate, hydroxypropyl acrylate, hydroxybutyl acrylate, hydroxyisobutyl acrylate, hydroxyethyl methacrylate, hydroxypropyl methacrylate, hydroxyisobutyl methacrylate, monomethyl maleate, dimethyl maleate, monoethyl maleate, diethyl maleate, 2-ethylhexyl acrylate, 2-ethylhexyl methacrylate, acrylamide, methacrylamide, N,N-dimethylacrylamide, N-tert-butylacrylamide, acrylonitrile, methacrylonitrile, dimethylaminoethyl acrylate, dimethylaminoethyl methacrylate, diethylaminoethyl acrylate, diethylaminoethyl methacrylate, the salts of the latter monomers with carboxylic acids or mineral acids, and the quaternized products. Other suitable monomers are acrylamidoglycolic acid, vinylsulfonic acid, allylsulfonic acid, methallylsulfonic acid, styrenesulfonic acid, 3-sulfopropyl acrylate, 3-sulfopropyl methacrylate, acrylamidomethylpropanesulfonic acid, and also monomers containing phosphonic acid groups, such as vinyl phosphate, allyl phosphate and acrylamidomethylpropanephosphonic acid.

Other suitable compounds from this group are N-vinylpyrrolidone, N-vinylcaprolactam, N-vinylimidazole, N-vinyl-2-methylimidazoline, diallylammonium chloride, vinyl acetate and vinyl propionate. Of course it is also possible to employ mixtures of the monomers mentioned in order, for example, to improve adhesion.

The copolymers should comprise, in copolymerized form, at least 20% by weight, preferably at least 50% by weight, of N-vinyl amides.

The copolymers can be prepared by known processes, for example by solution, precipitation, suspension or emulsion polymerization, using compounds which form free radicals under the polymerization conditions. In these polymerization processes the temperatures are conventionally in the range from 30° to 200° C., preferably from 40° to 110° C. Examples of suitable initiators are azo and peroxy compounds, and also the customary redox initiator systems, such as combinations of hydrogen peroxide and reducing compounds such as sodium sulfite, sodium bisulfite, sodium formaldehyde-sulfoxylate and hydrazine. In addition, small amounts of a heavy metal salt may be present in or absent from these systems.

The homo- and copolymers to be employed in accordance with the invention possess, in general, K values of from 7 to 300, preferably from 10 to 250, which may be measured according to the method of H. Fikentscher in aqueous solution at 25° C. and at concentrations which are between 0.1% and 5% depending on the particular K value.

The above-described homo- and/or copolymers of the general formula (I) undergo modification, by treatment with acids or bases, such that the formyl group is eliminated from the N-vinylformamide, incorporated by polymerization, resulting in the formation of amine or ammonium groups. The temperatures for this solvolysis are conventionally in the range of from 20° to 100° C., preferably from 70° to 90° C. Examples of suitable acids are carboxylic acids such as formic acid, acetic acid or propionic acid, a sulfonic acid such as benzenesulfonic acid or toluenesulfonic acid, or an inorganic acid such as hydrochloric acid, sulfuric acid, phosphoric acid or hydrobromic acid.

Suitable bases are sodium hydroxide, potassium hydroxide and ammonia, amines and alkaline earth metal bases such as calcium hydroxide.

The preparation of the homo- and copolymers and the subsequent solvolysis are described in, for example, DE-A-32 13 873 and DE-A-35 34 273.

For the desalination of the polymers the conventional methods are used, such as ion exchange, electrodialysis or ultrafiltration.

The method of the invention is especially useful for treating iron, ferro-alloys and chemically pretreated substrates, such as metal surfaces which have been phosphated and possibly afterwashed with water and/or a chromate solution. However, it is also useful for modifying the surfaces of zinc, aluminum, copper, cobalt, nickel and manganese.

As already mentioned above, the aqueous polymer solution is advantageously applied by dipping, pouring or spraying.

The solids contents of the polymer solutions used in the method of the invention may be between 0.01 and 5% by weight, preferably between 0.1 and 1% by weight, in the temperature range of from 20° to 80° C.

It has been possible to demonstrate the modification of the metal surface by the amino-containing organic polymer using secondary ion mass spectrometry (TOF-SIMS) and high-power scanning microscopy (e.g. SEM).

The metal surfaces, or chemically pretreated metal surfaces, modified by the method of the invention are in principle suitable for all applications for which chemically pretreated metal surfaces are employed. In conjunction with a coating the polymer coats bring about an extraordinarily large improvement in the resistance of the film exposed to corrosion against propagation of underfilm corrosion. This advantage becomes particularly clear in the case of cathodic electrodeposition, which is why the method is used with particular advantage for this type of coating. One example of the practical application of the method of the invention is in the automotive sector, for modifying phosphated bodywork.

In the examples parts and percentages are by weight unless otherwise stated.

General Testing Procedure

190×105×0.75 mm test panels were each dipped for 1 minute in aqueous polyvinylamine solutions (K value 30). The concentrations of the polymer solutions were 0.01%, 0.1%, 1% and 2%. The bath temperature was 23° C. and 50° C. respectively (see table). After drying in air the panels were dipped for a further 5 seconds in fully deionized water and redtied in air.

For further testing of the effectiveness, the pretreated test panels were coated with an electrodeposition coating material.

The electrodeposition coating material was employed in the form of a deposition bath solution like that given as a comparative example in DE-A-42 08 056. The coating material was deposited in a conventional manner at room temperature to the test panels, which were connected as cathode, and the panels were baked at 175° C. for 25 minutes. At deposition voltages of from 320 to 380 V coat thicknesses of 23 μm were achieved.

The adhesion of the coatings was determined using the underfilm corrosion at the cut as the parameter. For this purpose a 0.1 mm wide lengthways cut was made in the steel panels, and a 0.1 mm wide crossways cut into the coating on the panels having a phosphate conversion coat, said cut going down to the metal substrate.

The coated steel panels were then tested for corrosion resistance by a 15 day salt spray test (40° C., 5% strength NaCl solution: DIN 50 021). The coated steel panels with a phosphate conversion coat were tested by the saltwater soak test. For this purpose the test panel was immersed for 10 days in a 5% strength solution of NaCl which was heated at 55° C.

The table shows the maximum and the average extent of underfilm corrosion (in millimeters) to both sides of the cut site.

Using the procedure described above, the reference samples were electrodeposition-coated and then subjected to corrosion tests, the only difference being that no adhesion-promoting coat was applied.

EXAMPLE 1

A degreased steel body panel (e.g. St 1405) was immersed as indicated above in aqueous polyvinylamine solutions of various concentrations, then aftertreated and coated by electrodeposition.

EXAMPLE 2

A steel panel (BONDER® 26 60 OC) low-zinc-phosphated (spray method) and modified by manganese on both sides and then afterwashed with Cr(VI)/Cr(III) solution was immersed in aqueous polyvinylamine solutions of various concentrations, as indicated above, and processed further.

EXAMPLE 3

A steel panel (BONDER® 26 W OM) galvanized on one side and low-zinc-phosphated (spray method) and modified with manganese on the other side, and then afterwashed with Cr(VI)/Cr(III) solution, was immersed in aqueous polyvinylamine solutions of various concentrations, as indicated above, and processed further.

EXAMPLE 4

A steel panel (BONDER® 26 W OC) low-zinc-phosphated (spray method) and modified with manganese, and then afterwashed with water, was immersed in aqueous polyvinylamine solutions of various concentrations, as indicated above, and processed further.

The test results are compiled in the table.

The results of the examples are evaluated as follows:

In Examples 1 to 4 the corrosion test clearly indicates the advantages of the method of the invention, in comparison with prior art reference samples.

The extent of underfilm corrosion is reduced by the adhesion-promoting polymer coat by a factor of from two to three in the samples with a phosphate conversion coat. In the case of the steel panel of Example 2 the method of the invention prevents underfilm corrosion completely. The degreased steel body panel of Example 1 also shows reduced underfilm corrosion.

There is also evidence of a distinct improvement in the overall appearance of the film surface produced by the method of the invention, compared with the prior art. Whereas the film surfaces of the reference samples exhibit severe blistering, the film on metal surfaces modified using aqueous polyvinylamine solution is perfect.

The best results were obtained for panels with phosphate conversion coats treated at 50° C. with a 0.1% strength polyvinylamine solution. The lowest degree of underfilm corrosion on bright, untreated steel was obtained by treatment with a 1% strength polyvinylamine solution (using a 50° C. bath).

TABLE

| Panel | Conc. % by wt. | | | | | | | | Reference sample |
|---|---|---|---|---|---|---|---|---|---|
| | 0.01 | | 0.1 | | 1 | | 2 | | |
| | Temp. [°C.] | | | | | | | | |
| acc to | 23 | 50 | 23 | 50 | 23 | 50 | 23 | 50 | |
| Example 1 [1] | 13.2/11.3 | 10.2/9.8 | 12.0/10.9 | 10.7/10.1 | 11.5/11.1 | 9.2/8.8 | 13.4/12.1 | 13.0/12.4 | 13.9/12.4 |
| Example 2 [2] | 1.1/0.9 | 0.3/0.0 | 0.1/0.0 | 0.0/0.0 | 0.0/0.0 | 0.0/0.0 | 0.0/0.0 | 0.0/0.0 | 1.8/1.2 |
| Example 3 [2] | 4.8/4.6 | 5.7/5.3 | 4.7/4.4 | 3.9/3.5 | 4.4/4.2 | 6.1/5.6 | 5.8/5.5 | 6.0/5.3 | 9.2/8.7 |
| Example 4 [2] | 3.1/2.9 | 3.0/2.7 | 2.7/2.5 | 2.6/2.4 | 3.6/3.1 | 3.6/3.3 | 3.5/3.1 | 4.4/3.8 | 6.7/5.8 |

[1] Salt spray test (15 days/40° C., 5% strength NaCl solution)
[2] Saltwater soak test (10 days/55° C., 5% strength NaCl solution) The figures . . ./. . . in the table indicate the maximum and the average extent of underfilm corrosion to both sides of the cut in mm.

We claim:

1. A method of modifying chemically pretreated metal surfaces with aqueous solutions of organic polymers, wherein the chemically pretreated metal surfaces are treated with an aqueous solution of hydrolysis products of polymers comprising units of the formula (I)

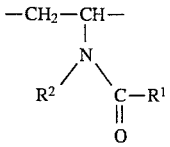

(I)

in which $R^1$ and $R^2$ are identical to or different from one another and are hydrogen or alkyl of 1 to 6 carbon atoms.

2. The method of claim 1, wherein the hydrolysis products of polymers of the formula I are hydrolysis products of homopolymers of N-vinylformamide.

3. The method of claim 1, wherein the hydrolysis products of polymers of the formula I are hydrolysis products of copolymers of N-vinylformamide and unsaturated carboxylic acids of 3–8 carbon atoms.

4. A method as defined in claim 1, wherein the treatment with the aqueous solution of organic polymers which contain amino groups is effected by pouring, spraying or dipping.

5. A method as defined in claim 1, wherein the metal surfaces are those of iron, ferro-alloys, zinc, aluminum, copper, cobalt, nickel or manganese.

6. A method as defined in claim 1, wherein the chemically pretreated metal surfaces are metal surfaces with phosphate conversion coats.

7. A method of coating metal surfaces, wherein the modified metal surfaces produced according to the method claimed in claim 1 are coated by cathodic electrodeposition.

* * * * *